US009882286B1

(12) United States Patent
Tonn

(10) Patent No.: US 9,882,286 B1
(45) Date of Patent: Jan. 30, 2018

(54) CYLINDRICAL ANTENNA USING NEAR ZERO INDEX METAMATERIAL

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1567 days.

(21) Appl. No.: 13/556,567

(22) Filed: Jul. 24, 2012

(51) Int. Cl.
*H01Q 19/06* (2006.01)
*H01Q 15/08* (2006.01)
*H01Q 15/00* (2006.01)

(52) U.S. Cl.
CPC ..... *H01Q 19/06* (2013.01); *H01Q 15/0086* (2013.01); *H01Q 15/08* (2013.01)

(58) Field of Classification Search
CPC ..... H01Q 15/08; H01Q 19/06; H01Q 15/0086
USPC ..... 343/790, 791, 807, 872
See application file for complete search history.

(56) References Cited

U.S. PATENT DOCUMENTS 2,615,131 A * 10/1952 Lindenblad ..... 343/770
7,429,957 B1 * 9/2008 Tonn ..... H01Q 13/203 343/709
7,580,604 B2 * 8/2009 D'Aguanno et al. ..... 385/129
2012/0280872 A1 * 11/2012 Werner ..... H01Q 15/0053 343/753

* cited by examiner

*Primary Examiner* — Dieu H Duong
*Assistant Examiner* — Michael Bouizza
(74) *Attorney, Agent, or Firm* — James M. Kasischke; Jean-Paul A. Nasser; Michael P. Stanley

(57) ABSTRACT

A cylindrical antenna includes: a hollow cylinder having a height, an inner radius b, an axis, a cylindrical surface, and two ends; a ground plane on one end of the cylinder; an antenna wire extending from a center of the cylinder at one end on a ground plane along the axis and ending below the height of the cylinder; and a layer of near zero index (NZI) metamaterial surrounding and adjacent to the cylindrical surface.

8 Claims, 2 Drawing Sheets

CYLINDRICAL ANTENNA USING NEAR ZERO INDEX METAMATERIAL

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention is generally directed towards a cylindrical antenna and more specifically directed towards a cylindrical antenna using near zero index metamaterial.

(2) Description of the Prior Art

A near-zero index (NZI) metamaterial is an engineered material that is designed to produce anomalous refraction over a certain range of frequencies. It gets its name from the fact that its effective index of refraction n from Snell's Law of Optics is approximately equal to zero. This near-zero index of refraction implies that "rays" penetrating a planar interface between an NZI material and free space will always refract so that they are nearly parallel with the normal to the interface. If such an NZI material is used as a superstrate or cover layer above a planar antenna, the result will be an increase in the gain of the antenna, as a result of the collimation of the energy leaving the structure. In other words, an increase in overall directivity is obtained by the introduction of the NZI layer into a planar antenna.

Chaimool et al. discloses use of a metamaterial reflective surface (MRS) as a superstrate for a single-feed circularly polarized microstrip patch antenna (SFCP-MPA). Simultaneous enhancement on antenna gain, impedance bandwidth (ZBW) and axial-ratio bandwidth (ARBW) are obtained by adding the MRS atop the SFCP-MPA. The MRS can enhance the ZBW and ARBW by 3.5 and 9.9 times, respectively, compared to the circularly polarized patch source. Moreover, the gain of the CP-MPA with the MRS is 7 dB higher than that of the conventional CP-MPA. A relatively small spacing between the MRS and patch source results in a low profile antenna that well suits modern wireless communications. S. Chaimool, K. L. Chung, and P. Akkaraekthalin, "Simultaneous gain and bandwidths enhancement of a single-feed circularly polarized microstrip patch antenna using a metamaterial reflective surface," *Progress In Electromagnetics Research B*, Vol. 22, 23-37, 2010.

D. H. Lee et al. discloses a device for enhancing the directivity and port isolation of a dual-frequency dual-polarization (DFDP) microstrip antenna by using metamaterial superstrates and substrates. To enhance the directivity of this without a complex feed network, the device includes a strip-mesh type of Frequency Selective Surface (FSS) type superstrate as a cover for a DFDP antenna, which supports two orthogonal polarizations at two different resonant frequencies. Then a 2D anisotropic uniplanar compact band gap type ground plane is introduced to enhance the isolation between the two ports of the DFDP antenna. The directivity at two frequency bands is enhanced by about 13 dB in the first band and by ~12 dB in the second band, when compared with the patch antenna alone. Also, the isolation between the two ports is shown to be −35 dB, which is −15 dB lower than that of a conventional patch antenna. Lee, D. H., Lee, Y. J., Yeo, J., Mittra, R. and Park, W. S. "Design of metamaterial superstrates and substrates for directivity and port isolation enhancement of a dual-frequency dual-polarization microstrip antenna", *Microwave and Optical Technology Letters,* 48: 1873-1876 (2006). Published online in Wiley InterScience (www.interscience.wiley.com).

The theoretical modeling and prototype demonstration of broadband, low loss, and dual polarization capability of a gradient index metamaterial lens using multilayer microstrip square ring arrays includes microstrip closed square ring elements of variable size distributed on a planar substrate to satisfy the radial gradient index function and axial impedance match layer configuration of the lens. The lens is designed to transform spherical wave-front into planar wave-front and minimize reflection loss. A prototype gradient index lens antenna composed of multilayer of CSR arrays and a PEC horn are modeled and simulated. The simulation results shows that the prototype lens antenna maintain low return loss and high directivity over X-band, verifying the feasibility of such a light weight slab metamaterial lens for broadband and high directivity antenna application, such as in radar and communication system. Hang Zhou et al, "A Novel High-Directivity Microstrip Patch Antenna Based on Zero-Index Metamaterial," *IEEE Antennas and Wireless Prop. Letters*, vol. 8, no., pp. 538-541, 2009.

Metamaterials have also been used for a traditional Vivaldi antenna having an ultrawide bandwidth, but low directivity. To enhance the directivity, a high-gain Vivaldi antenna is based on compactly anisotropic zero-index metamaterials (ZIM). Such anisotropic ZIM are designed and fabricated using resonant meanderline structures, which are integrated with the Vivaldi antenna smoothly and hence have compact size. Measurement results show that the directivity and gain of the Vivaldi antenna have been enhanced significantly in the bandwidth of anisotropic ZIM (9.5-10.5 GHz), but not affected in other frequency bands (2.5-9.5 GHz and 10.5-13.5 GHz). Bin Zhou and Tie Jun Cui, "Directivity Enhancement to Vivaldi Antennas Using Compactly Anisotropic Zero-Index Metamaterials", *IEEE Antennas and Wireless Prop. Letters*, Vol. 10, 2011.

SUMMARY OF THE INVENTION

Accordingly, it is an object of the present invention to provide a cylindrical antenna and method with a near-zero metamaterial to increase both gain and bandwidth of the antenna.

The above and other objects and advantages of the present invention will become apparent in view of the following description, claims and drawings. A cylindrical antenna includes: a hollow cylinder having a height, an inner radius b, an axis, a cylindrical surface, and two ends; a ground plane on one end of the cylinder; an antenna wire extending from a center of the cylinder at one end on a ground plane along the axis and ending below the height of the cylinder; and a layer of near zero index (NZI) metamaterial surrounding and adjacent to the cylindrical surface.

DESCRIPTION OF THE PREFERRED EMBODIMENT(S)

This invention uses the unusual properties of a near zero index metamaterial to improve the gain of a cylindrical antenna, while also providing a significant increase in the antenna bandwidth. In the first models of this invention, the NZI metamaterial was a hollow cylinder whose axis antenna was coincident with the axis of the cylindrical antenna driving the system. Offsetting the axis of the antenna from the axis of the cylinder, while keeping the two axes parallel, also provides bandwidth improvement.

An NZI metamaterial is an engineered material that is designed to produce anomalous refraction over a certain range of frequencies. It gets its name from the fact that its effective index of refraction n from Snell's Law of Optics is approximately equal to zero. This near-zero index of refraction implies that "rays" detected by the antenna that are penetrating a planar interface between an NZI material and free space will always refract so that they are nearly parallel with the normal to the interface. If such an NZI material is used as a superstrate or cover layer above a planar antenna, the result will be an increase in the gain of the antenna, as a result of the collimation of the energy leaving the structure (i.e. an increase in overall directivity is obtained by the introduction of the NZI layer.) This effect is illustrated in FIGS. 1A and 1B.

Figure 1A:
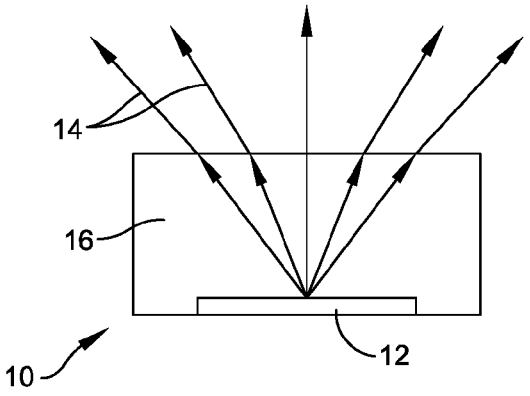
FIG. 1A (PRIOR ART)
FIG. 1A is a schematical side view of a planar patch antenna constructed of normal materials.

FIG. 1A is a schematical side view of a planar patch antenna 10 constructed of normal materials 16 without the use of any NZI metamaterial, and including a ground plane 12 whereby the rays 14 detected by the antenna 10 are refracted in various directions that are not necessarily parallel with the normal to the interface with the ground plane 12.

Figure 1B:
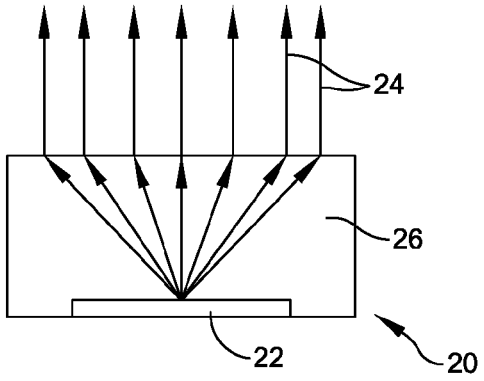
FIG. 1B (PRIOR ART)
FIG. 1B is a schematical side view of a planar patch antenna including a layer of near-zero index metamaterial.

FIG. 1B is a schematical side view of a planar patch antenna 20 constructed with a layer 26 of NZI metamaterial, and including a ground plane 22 whereby the rays 24 detected by the antenna 20 are refracted nearly parallel, normal to the interface with the ground plane 22.

The NZI layer is spaced approximately one half of a guided wavelength above the patch antenna in order to create a pseudo-Fabry-Perot cavity effect that appears to further enhance the gain of the antenna. The present invention extends the idea of using the cavity effect combined with the anomalous refractive properties of NZI materials to a cylindrical geometry.

Figure 2:
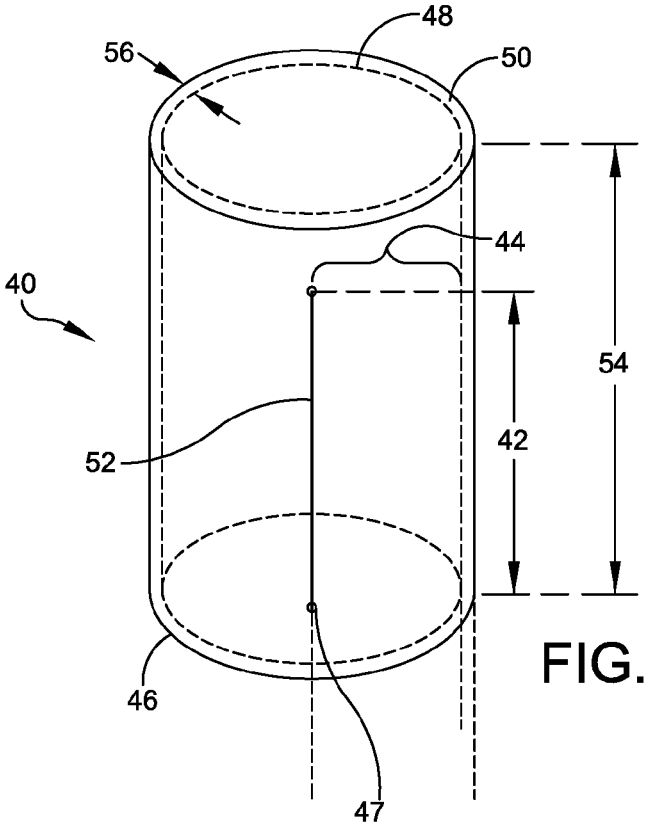
FIG. 2 is a cylindrical antenna including a layer of near-zero index metamaterial surrounding the cylindrical surface according to the principles of the invention.

FIG. 2 illustrates a cylindrical antenna 40, in this case a tuned monopole 52 having a length 42 of 95 mm and a radius of 1 mm, above a truncated ground plane 46, wherein tuned monopole 52 is joined to ground plane 46 through an aperture 47 in the ground plane 46, inside a hollow cylinder 48 surrounded along the outer cylindrical surface by a layer 50 of NZI metamaterial. The inner radius 44 of the cylinder 48 is 110 mm, and the outer radius from the center of the monopole 52 to the outside of the NZI layer is 130 mm. The NZI layer 50 has a thickness 56 of 20 mm, and the height 54 of the cylinder 48 is 400 mm. The cylinder could be filled with air, a low dielectric foam or similar material for support. Other antennas which are rotationally symmetrical about their vertical axes could also be used. These include, but are not be limited to, dipole antennas and biconical antennas.

The anomalous refraction occurs only in the elevation plane here, owing to the symmetry of the problem. So it is reasonable to expect that the amount of improvement in gain performance would not be as high here as it would be in the planar cases reported in the literature where anomalous refraction can occur in two planes (the two cardinal planes mutually orthogonal to each other and to the plane of the patch antenna.)

The NZI medium is represented using the so-called Effective Medium Theorem or EMT. Under the EMT, the material is characterized as being uniform but its dielectric properties are given by a dispersion relationship. If the material is isotropic, this relationship is a simple algebraic one; if the material is anisotropic, the dispersion relationship becomes a tensor relationship. For the purposes of our discussion here, the material will be assumed to be isotropic and its dielectric constant given by the lossy Drude Model, popularly used throughout the literature: (assuming exp(jω t) time variation)

$$\varepsilon_r(\omega) = n^2(\omega) = 1 - \frac{\omega_p^2}{\omega(\omega - j\gamma)} \tag{1}$$

In Equation (1), there are two figures of merit that define the frequency dependence of the dielectric constant of the material; these are the effective plasma frequency $\omega_p$ and the damping coefficient, $\gamma$. An examination of this formula shows that the region of NZI performance occurs near the effective plasma frequency $\omega_p$, since the refractive index n varies as the square root of the real portion of the dielectric constant. It is therefore a key aspect of this invention that the antenna operates near this effective plasma frequency $\omega_p$ in order to obtain the anomalous refraction that the NZI cylinder produces.

The proper choice of the inner diameter of the cylinder 48 is also very important for proper operation of this invention. Much like in the case of the planar antennas reported in the literature, the best performance here appears to be obtained when the cylinder supports a resonant cavity mode. Unlike the planar case, though, the resonant condition here does not occur at a half-wave resonance.

In one embodiment, the resonant wave number $k_r$ may be defined by a transcendental equation. Assuming that the resonance of the cylinder occurs near the plasma frequency $\omega_p$ of the NZI metamaterial, the wave number $k_r$ can be shown to satisfy the following eigenvalue Equation (2).

$$Y_1(k_r b) \approx \frac{2}{\pi} J_1(k_r b)\ln(\eta k_r b) \tag{2}$$

Here, J and Y are first-order Bessel functions of the first and second kind, respectively, $k_r$ is the resonant wave number, and $\eta$ is a geometry factor involving the ratio of the inner radius of the cylinder, b, and the outer radius of the antenna. It is a further key aspect of this invention that the inner radius of the cylinder, b, satisfies this eigenvalue equation near the frequency of operation. It has been observed that the performance of this invention appears to be insensitive to the value of the outer radius of the cylinder, meaning that the cylinder could in fact be implemented as a thin sheet of material. Also, the thickness of the NZI layer 50 is not critical.

Figure 3:
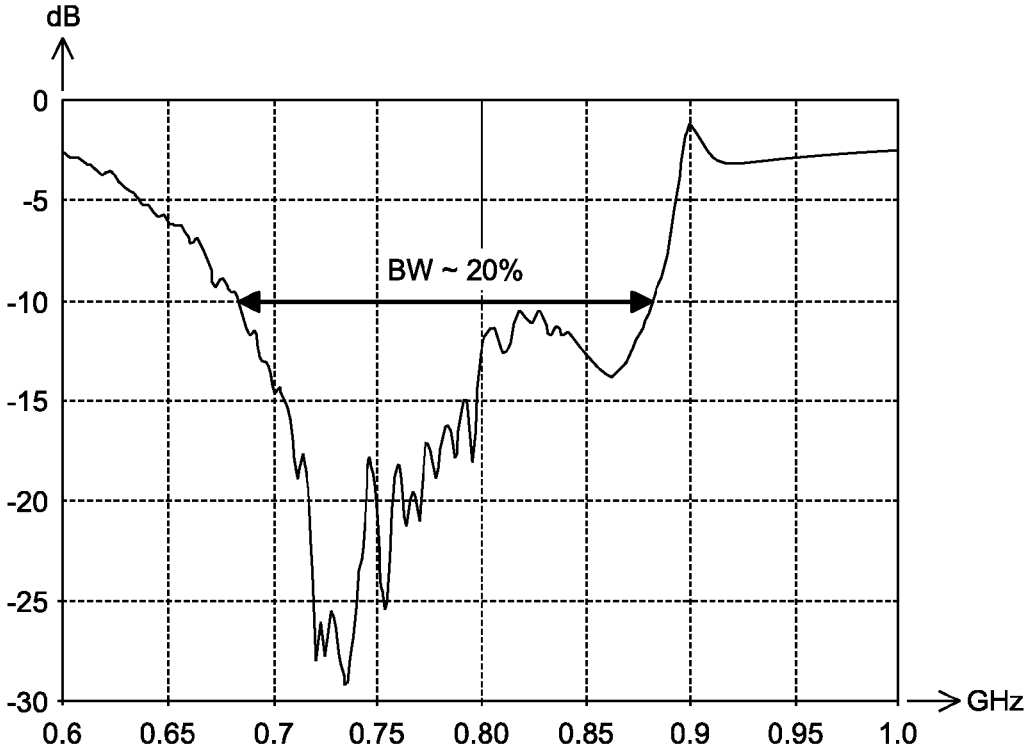
FIG. 3 is a chart of operational test data of a cylindrical antenna including a layer of NZI metamaterial showing an S parameter magnitude in decibels in relation to frequency variation in GHz.
Figure 4:
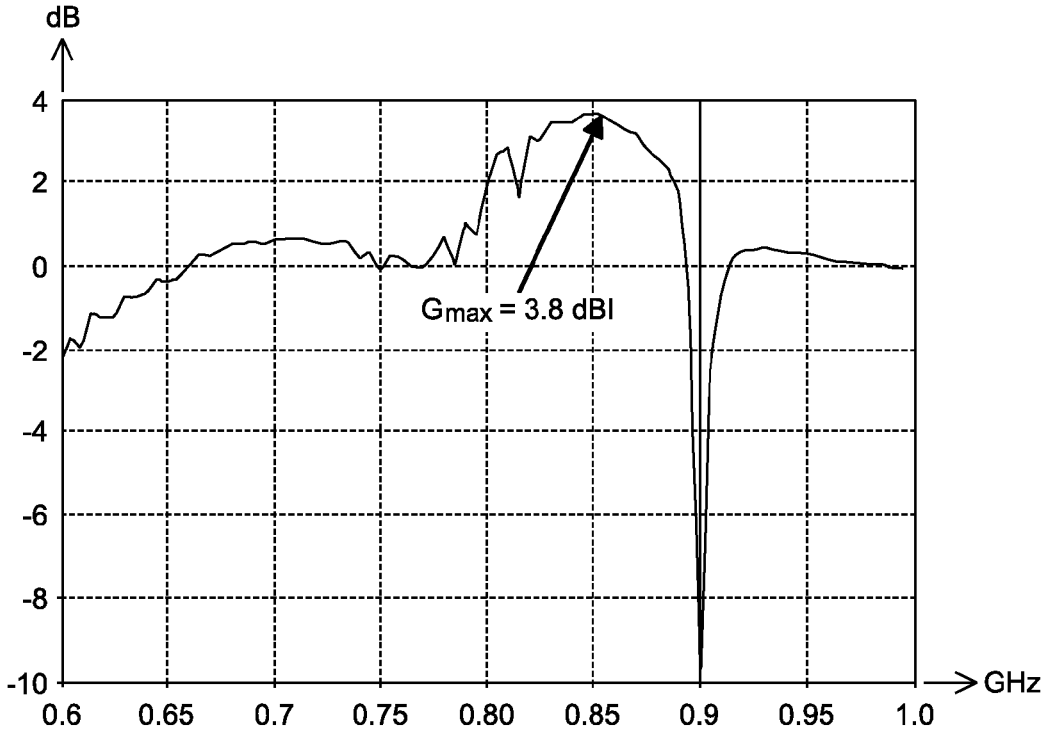
FIG. 4 is a chart of operational test data of a cylindrical antenna including a layer of NZI metamaterial showing the gain in decibels in relation to frequency variation in GHz.

FIGS. 3 and 4 show the simulated Voltage Standing Wave Ratio (VSWR) and realized gain (in decibel units) of one example of this invention. For the purposes of the EMT used in the model, the plasma frequency $\omega_p$ was chosen to be 900 MHz and the damping is $\gamma$=20 MHz. The results were obtained using CST Microwave Studio—a commercial simulation package based on the finite integral method of simulation. The data presented in FIG. 3 indicates that the fractional bandwidth BW of the structure is on the order of 20%. A simulation was performed without the cylinder shown in FIG. 2 present (i.e. with only the monopole antenna and ground plane present) and the fractional bandwidth of that structure was seen to be only ~5%. Thus, the property of improved bandwidth is demonstrated in this model.

The effect of increased gain is shown in FIG. 4. A peak gain of 3.8 dBi is noted; without the cylinder present, the gain was only around 0 dBi. Decibels relative to isotropic or dBi is defined as the measurement of gain in a directional antenna compared with a theoretical "isotropic antenna," which radiates the exact same energy in all directions. Thus the method of this invention allows an increase in realized gain of over 3 dB to be readily obtained.

Of note in FIG. 4 is the "dropout" near 900 MHz; this is an artifact of the EMT model used. Since the plasma frequency $\omega_p$ was 900 MHz, the equation for the dielectric constant gives a value of very nearly zero at 900 MHz. This translates to a nearly infinite intrinsic impedance which results in a near total mismatch between the NZI cylinder and the air inside of it at 900 MHz. This mismatch causes the dropout. In a real NZI material, the material would not be perfectly homogenous and isotropic, and so this effect would be minimized.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A cylindrical antenna comprising:

a hollow cylinder having a height, an inner radius b, an axis, a cylindrical surface, and two ends;

a ground plane joined to one end of the cylinder;

an antenna wire extending from a center of the cylinder proceeding from the end of the cylinder that is joined to the ground plane through an aperture in the ground plane along the axis and ending below the height of the cylinder; and a layer of near zero index (NZI) metamaterial surrounding and adjacent to the cylindrical surface.

2. The cylindrical antenna of claim 1 wherein the NZI metamaterial is isotropic and obeys the relationship:

$$\varepsilon_r(\omega) = n^2(\omega) = 1 - \frac{\omega_p^2}{\omega(\omega - j\gamma)}$$

where $\omega_p$ is an effective plasma frequency, $\gamma$ is a damping coefficient, n is a refractive index, $\omega$ is the angular frequency of operation, j is the square root of −1, and $\in_r$ is a relative dielectric constant of the metamaterial.

3. The cylindrical antenna of claim 2 wherein the effective plasma frequency $\omega_p$ is within 25% of an operational frequency of the antenna.

4. The cylindrical antenna of claim 3 wherein an inner diameter of the hollow cylinder supports a resonant cavity mode.

5. The cylindrical antenna of claim 3 wherein the radius b obeys the relationship:

$$Y_1(k_r b) \approx \frac{2}{\pi} J_1(k_r b) \ln(\eta k_r b)$$

where $Y_1$ and $J_1$ are first order Bessel functions of first and second kind, respectively, $k_r$ is a resonant wave number being $2/\pi$ times the operational frequency, b is the inner radius, and n is a geometry factor involving a ratio of b and an outer radius of the antenna.

6. The cylindrical antenna of claim 1 wherein the NZI metamaterial is anisotropic.

7. The cylindrical antenna of claim 1 wherein the cylinder is filled with air or low dielectric foam.

8. The cylindrical antenna of claim 1 comprising one of a monopole, a dipole and a bicone antenna.

* * * * *